US007413450B2

(12) United States Patent
Forman

(10) Patent No.: US 7,413,450 B2
(45) Date of Patent: Aug. 19, 2008

(54) PRINTED CIRCUIT BOARD ASSEMBLY HAVING A BGA CONNECTION

(75) Inventor: Steven K. Forman, Harrisburg, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 289 days.

(21) Appl. No.: 11/347,110

(22) Filed: Feb. 3, 2006

(65) Prior Publication Data

US 2006/0128184 A1 Jun. 15, 2006

Related U.S. Application Data

(63) Continuation of application No. 10/208,070, filed on Jul. 29, 2002, now abandoned.

(51) Int. Cl.
*H01R 12/00* (2006.01)

(52) U.S. Cl. ..... 439/83

(58) Field of Classification Search ..... 439/608, 439/108, 701, 79, 83, 70, 71, 610; 361/760; 174/262–263, 255

See application file for complete search history.

(56) References Cited

U.S. PATENT DOCUMENTS

| | | | | |
|---|---|---|---|---|
| 4,571,014 | A | 2/1986 | Robin et al. | 339/14 |
| 5,026,292 | A | 6/1991 | Pickles, et al. | 439/108 |
| 5,527,189 | A | 6/1996 | Middlehurst et al. | 439/608 |
| 5,730,606 | A | 3/1998 | Sinclair | 439/70 |
| 5,895,281 | A | 4/1999 | Rothenberger | 439/326 |
| 5,924,899 | A | 7/1999 | Paagman | 439/701 |
| 5,928,005 | A | 7/1999 | Li et al. | 439/82 |
| 6,024,584 | A | 2/2000 | Lemke et al. | 439/83 |
| 6,083,047 | A | 7/2000 | Paagman | 439/608 |
| 6,102,747 | A | 8/2000 | Paagman | 439/701 |
| 6,109,976 | A | 8/2000 | van Zanten et al. | 439/689 |
| 6,116,921 | A | 9/2000 | Scholz et al. | 439/83 |
| 6,139,336 | A | 10/2000 | Olson | 439/83 |
| 6,171,149 | B1 | 1/2001 | van Zanten | 439/608 |

(Continued)

FOREIGN PATENT DOCUMENTS

EP 0 752 739 B1 1/1997

(Continued)

OTHER PUBLICATIONS

FCI Electronics, Incorporated, "FCI-Search by Product Type", 3 pages, May 9, 2001, www.berg.com/red/producttype/red_pt_ electronics.htm

*Primary Examiner*—Edwin A. León
(74) *Attorney, Agent, or Firm*—Woodcock Washburn LLP

(57) ABSTRACT

An electrical connector may have a housing which has one or more printed circuit board assemblies. Each printed circuit board assembly has a plurality of signal traces and ground traces. Attached to the printed circuit board assemblies is a base. Disposed within one side of the base are a plurality of slots for receiving the printed circuit board assemblies. The opposing side of the base may have a plurality of pockets for receiving a plurality of fusible elements, which are preferably solder balls. Holes in the base provide a passage from the slots to the pockets. The solder balls are connected to the signal trace ends which extend into the base slots by metallic elements, such as contacts or solder paste.

15 Claims, 6 Drawing Sheets

U.S. PATENT DOCUMENTS

| | | | | |
|---|---|---|---|---|
| 6,183,301 | B1 | 2/2001 | Paagman | 439/608 |
| 6,431,889 | B1 | 8/2002 | Olson | 439/157 |
| 6,540,558 | B1 | 4/2003 | Paagman | 439/608 |
| 6,544,045 | B1 | 4/2003 | Paagman | 439/79 |
| 6,638,110 | B1 * | 10/2003 | Billman | 439/608 |
| 6,663,426 | B2 | 12/2003 | Hasircoglu et al. | 439/608 |
| 2004/0253852 | A1 | 12/2004 | Regnier, et al | 439/83 |

FOREIGN PATENT DOCUMENTS

| | | |
|---|---|---|
| WO | WO 97/02627 | 1/1997 |

* cited by examiner

FIG. 5B
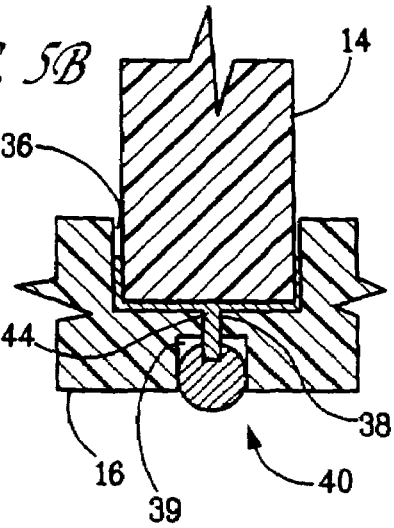
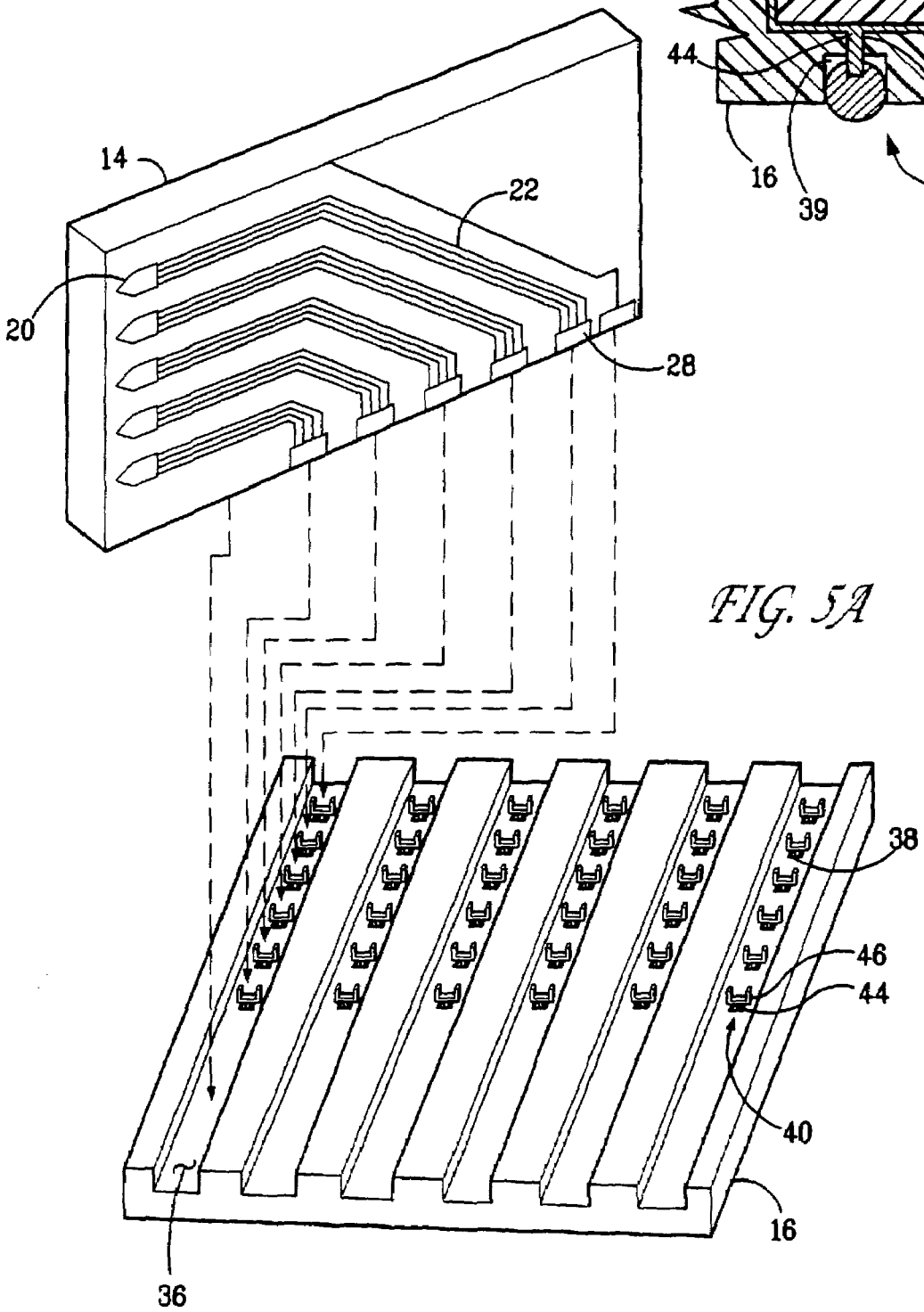
FIG. 5A

PRINTED CIRCUIT BOARD ASSEMBLY HAVING A BGA CONNECTION

CROSS-REFERENCE TO RELATED CASES

This is a continuation of U.S. patent application Ser. No. 10/208,070 filed Jul. 29, 2002, the entirety of which is incorporated herein by reference.

FIELD OF THE INVENTION

This invention relates to a printed circuit board assembly having a ball grid array (BGA) connection.

BACKGROUND OF THE INVENTION

Ball grid array connectors are generally known in the art and a general discussion of such connectors can be found in U.S. Pat. No. 5,730,606, which is hereby incorporated by reference. These types of connectors generally include fusible elements, preferably spherical solder balls, that are positioned on electrical contact pads of a circuit substrate or disposed within a ball pocket. The plurality of solder balls is generally referred to as a ball grid array. An integrated circuit may be mounted to a plastic or ceramic substrate PCB Materials (FR-4) and electrically connected to the ball grid array. Among the advantages of ball grid array connectors are smaller package sizes, good electrical performance and lower profiles.

Ball grid arrays have been used in connection with printed circuit boards. For example, FCI Electronics, Inc.'s U.S. Pat. Nos. 6,183,301 B1 and 6,083,047 disclose printed circuit boards having a ball grid array connection and are hereby incorporated by reference. Broadly, this invention relates to an improved electrical connector having an improved BGA connection. In an embodiment, this invention relates to improved printed circuit board assemblies that have an improved connection between the traces of the printed circuit board and the fusible elements or solder balls.

SUMMARY OF THE INVENTION

An electrical connector of this invention includes a housing, which has a base, at least one circuit board, at least one fusible element, and a metallic element. The at least one circuit board is disposed within the housing and includes at least one signal trace. The at least one fusible element is disposed within the housing base, and the metallic element couples a first end of the signal trace to the at least one fusible element. Although the metallic elements may have a number of embodiments, the metallic element preferably has a pair of arms between which at least one circuit board fits.

The connector may also have at least one solder pad that couples the metallic element to the signal trace first end. Preferably, the solder pad is disposed on part of one lateral face of the circuit board. In another preferred embodiment, the connector has another solder pad disposed on the other lateral face of the solder pad, so that the metallic element is in contact with both solder pads to place the printed circuit board signal trace in electrical communication with the at least one fusible element.

In a preferred embodiment, at least one circuit board includes a module that can be inserted into and removed from the housing. Preferably, the at least one circuit board is inserted into a slot in the housing base, and the metallic elements are disposed within the base slot.

Preferably, the housing base has holes disposed within each slot that correspond to each signal trace of the printed circuit bond assembly. Disposed beneath each hole is a pocket in which a fusible element is disposed. Each of the metallic elements preferably extend from a slot, through a hole, and into a pocket. Thus, an electrical connection is made from the signal trace, to the metallic element, and to the fusible element. Another electrical component can be mated with the connector by mating contacts of pads of the other electrical component with the fusible elements.

In other preferred embodiments, the metallic elements are not used. In these embodiments, the circuit board assembly is inserted into a base slot and solder paste is heated and flows within the base slot to form an electrical connection between the solder paste and the circuit board signal traces. The solder paste also flows through the base and into contact with the fusible element. Thus, an electrical connection is formed from the PCB signal traces to the solder paste and to the fusible elements.

Other features of the invention are set forth below.

BRIEF DESCRIPTION OF THE DRAWINGS

FIG. 5A is an assembly view of a printed circuit board and a base according to a preferred embodiment of this invention;

FIG. 5B is a cross-section taken through one of the base pockets of FIG. 5A with the assembly installed;

DETAILED DESCRIPTION OF PREFERRED EMBODIMENTS

Figure 1:
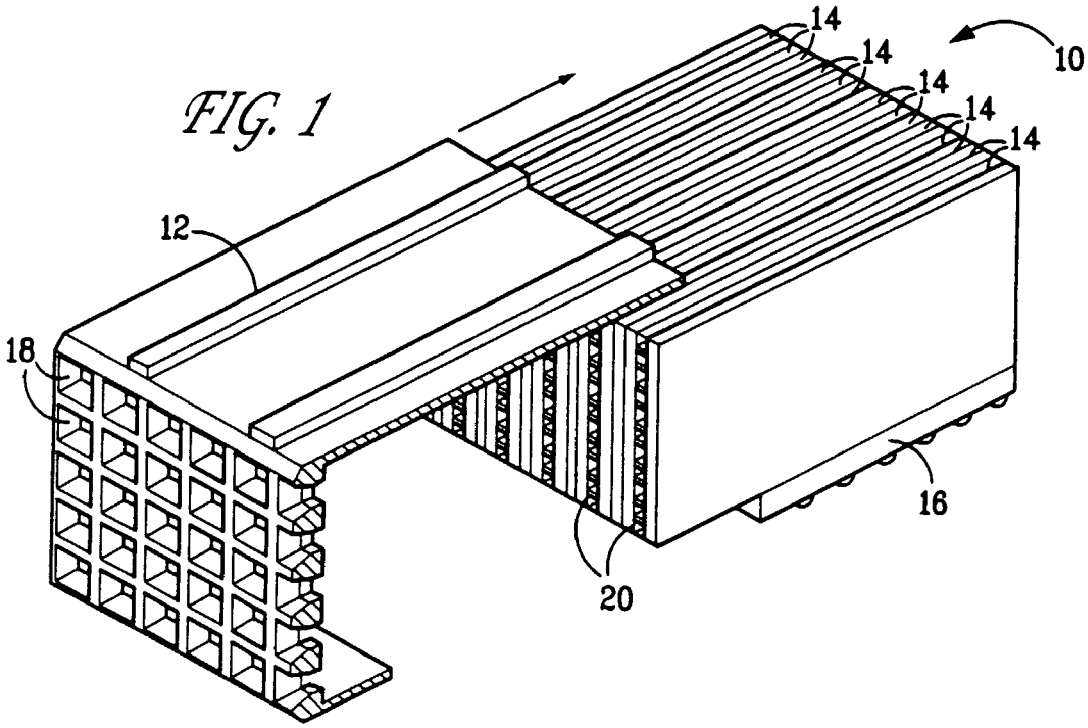
FIG. 1 is an assembly view of a connector according to a preferred embodiment of this invention.

FIG. 1 depicts an assembly of a preferred embodiment of an electrical connector 10 according to a preferred embodiment of this invention. Although it need not be, the connector 10 is in the embodiment shown a right angle connector. The connector 10 preferably has a housing 12, a plurality of printed circuit board assemblies 14, and a base 16. Preferably, the printed circuit board assemblies 14 are removeable from the housing 12.

In the preferred embodiment of FIG. 1, the connector 10 has five printed circuit board assemblies 14. The connector 10 of this invention can have any number of printed circuit boards 14, and eleven are shown for illustrative purposes. The printed circuit boards 14 can have a number of applications and circuits depending upon their application.

FIG. 1 depicts a portion of an embodiment of the housing 12. The housing 12 can be made from any suitable material such as a thermoplastic. The housing 12 has a plurality of lead in holes 18. The lead in holes are for receiving a terminal of a mating connector (not shown). The housing 12 may have any number of lead in holes, and therefore only a portion of the housing 12 is shown in FIG. 1. As shown, each of the lead in holes 18 is aligned with a contact terminal 20 of a printed circuit board assembly 14.

Figure 2:
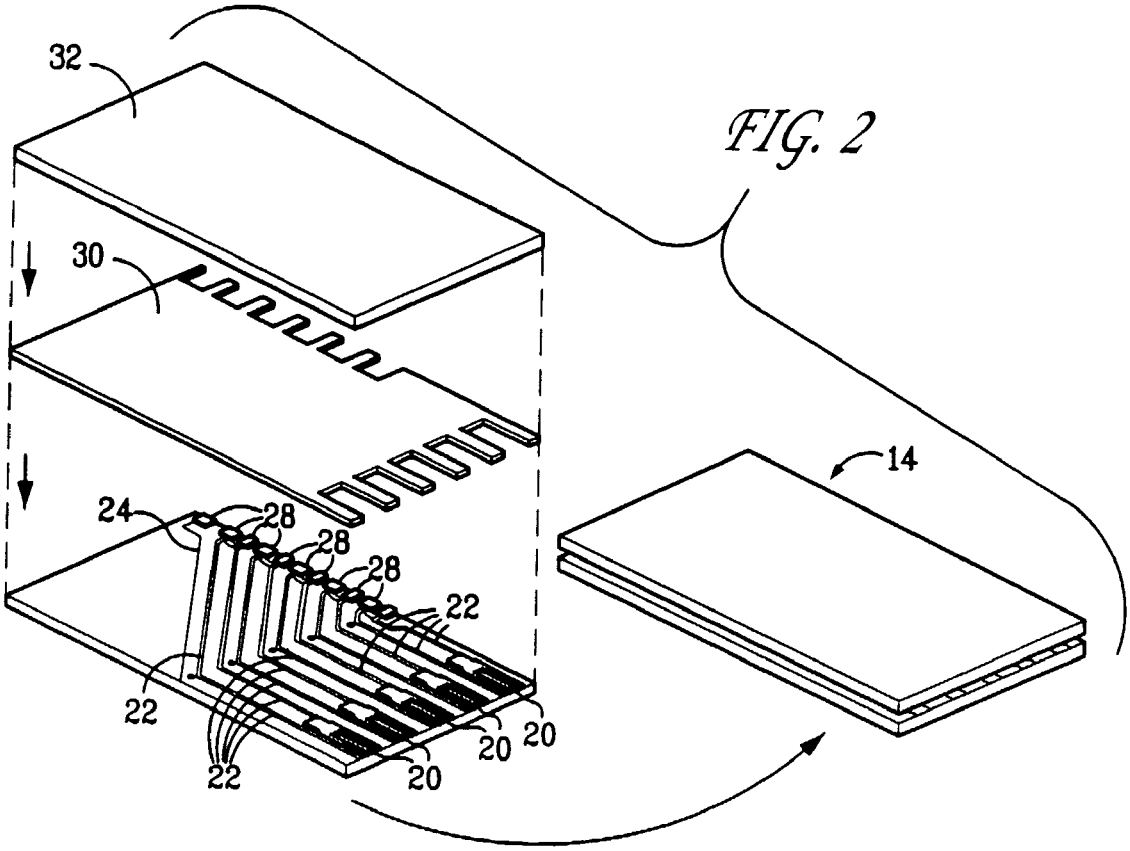
FIG. 2 is an assembly view of a portion of the preferred embodiment of FIG. 1.

The printed circuit board assemblies 14, which are best shown in FIG. 2, each preferably include a substrate 16 that has a plurality of signal traces 22 and a plurality of ground traces 24. The substrate 16 may have a ground contact that is in communication with the ground trace 24. The ground contact is preferably a fusible element, and even more preferably a solder ball. In a preferred embodiment, a plurality of printed circuit board pads 28 may be attached to the signal traces 22. In other preferred embodiments, solder pads are not used. Preferably, the printed circuit board pads 28 are constructed from solder. Disposed over the substrate may be a dielectric material which may be an insulating spacer 30. Disposed over the insulating spacer may be an insulating cover 32. The dielectric material 30 and the insulating cover 32 are attached to the substrate 16 to form a printed circuit board assembly 14 as shown in FIG. 2. Disposed at an end of each signal trace 22 is a contact terminal 20. As shown in FIGS. 1 and 2, the contact terminals 20 are aligned with the housing lead in holes 18. The contact terminals 20 are for receiving a corresponding contact of another connector to make an electrical connection between the signal traces 22 and another electrical component.

Figure 3:
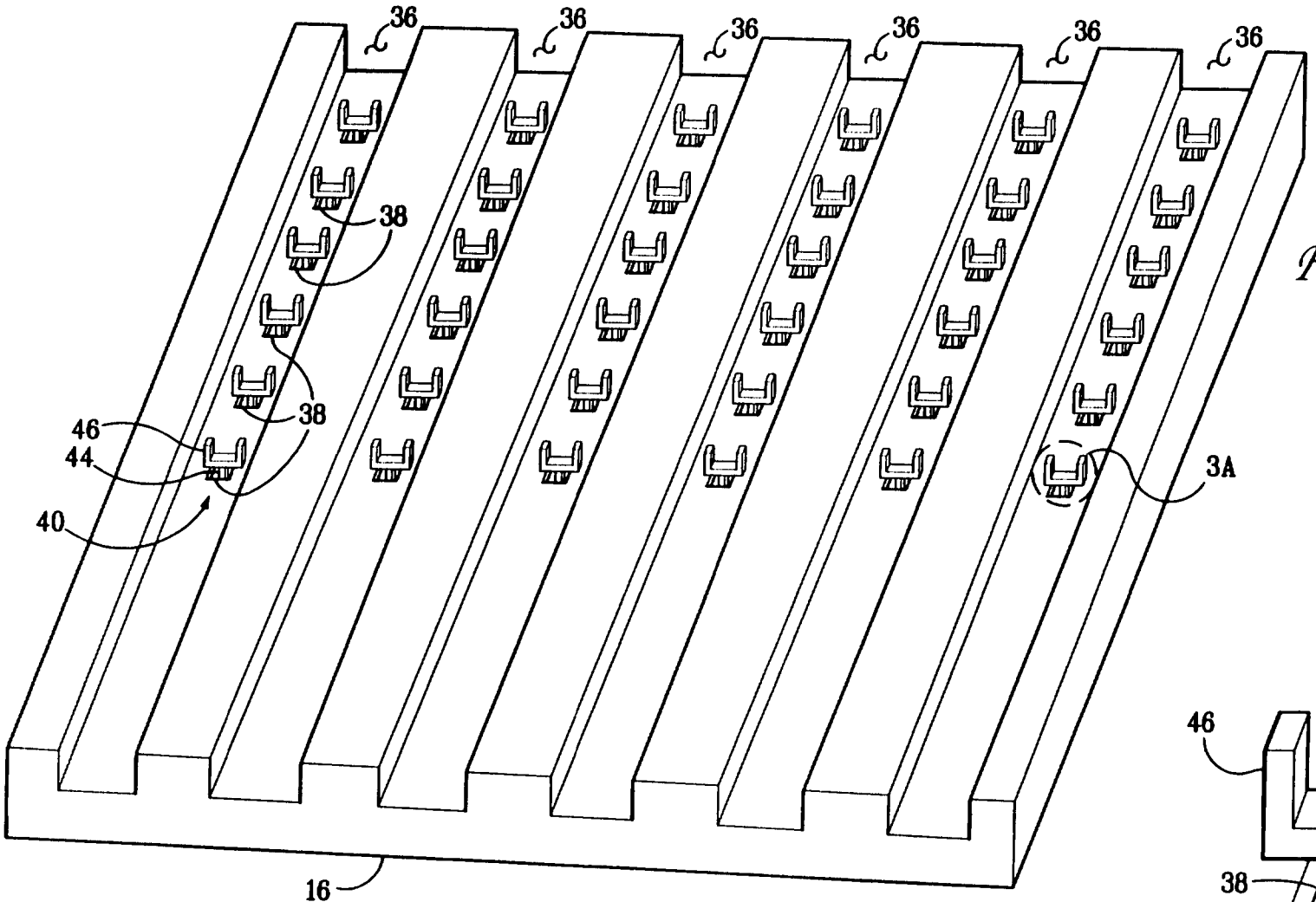
FIG. 3 is an perspective top view of a preferred embodiment of the base portion of the connector of FIG. 1.
Figure 3A:
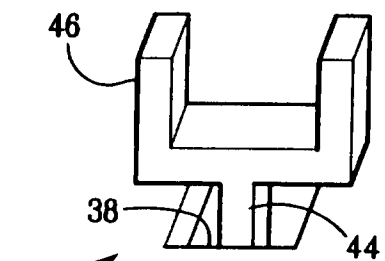
FIG. 3A is an enlarged view of detail 3A of FIG. 3.
Figure 4:
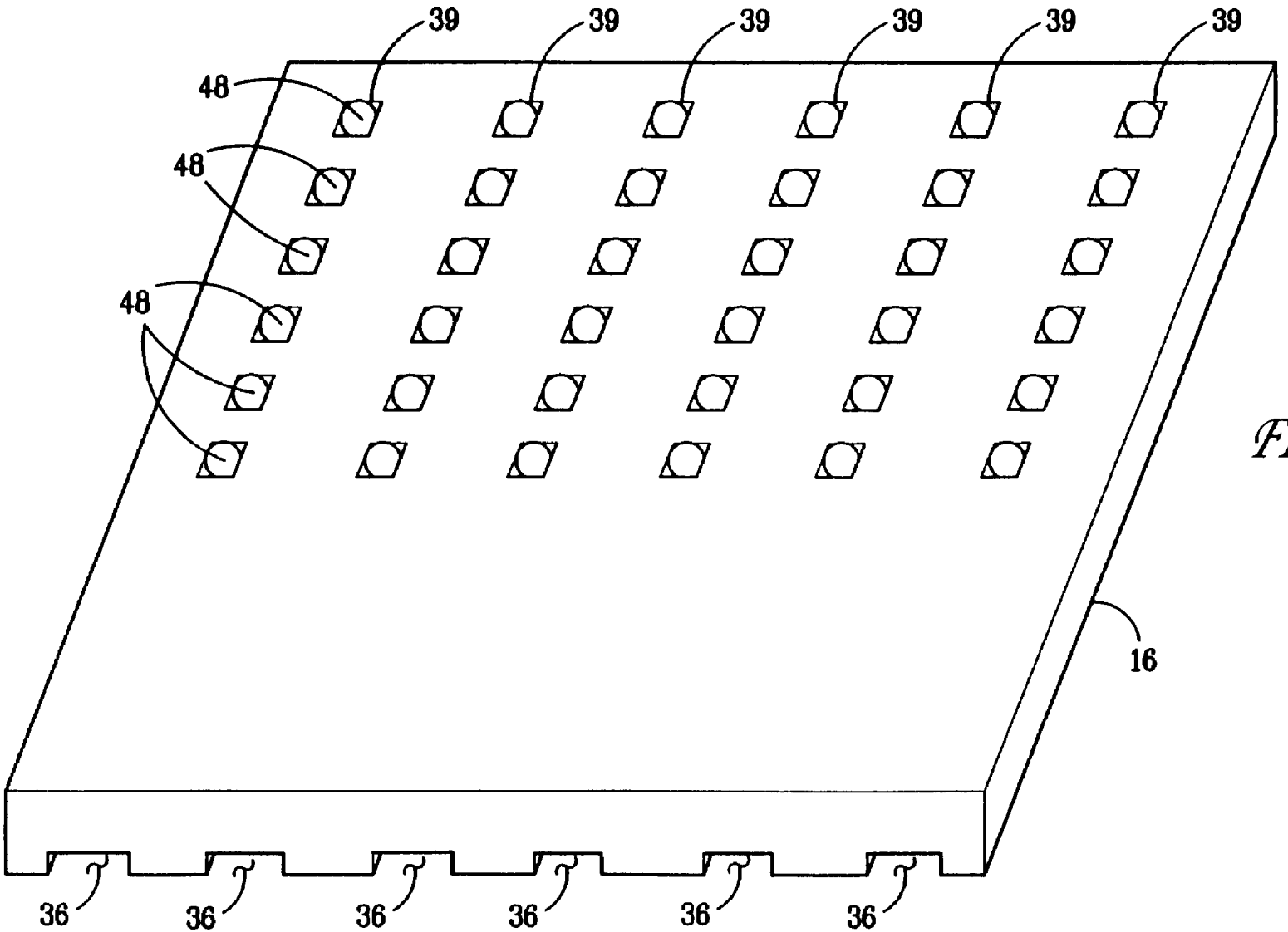
FIG. 4 is a perspective bottom view of the base of FIG. 3.

Shown in the perspective views of FIGS. 3 and 4 is the housing base 16, which is attached to the printed circuit board assemblies 14 as shown in FIG. 1. FIG. 3 is a perspective view of the top of the base 16, and FIG. 4 is a perspective view of the bottom of the base 16. The housing base 16 is preferably constructed of a high temperature plastic material. Although the base 16 need not be, the base 16 is preferably constructed as a single piece and is molded. The base 16 serves to form a connection between the signal traces 22 and the ground trace 24 and another electrical element, such as a printed circuit board, as shown (and explained below) in the cross-sectional view of FIG. 6.

As shown in FIG. 3, there may be a plurality of slots 36 disposed within the base 12. Each of these slots 36 receives a printed circuit board assembly 14 as shown in the assembly drawing of FIG. 5A. Although only one printed circuit board assembly 14 is shown as being inserted into one slot 36 in FIG. 5, it will be appreciated that a printed circuit board assembly 14 is disposed in each base slot 36 as shown in FIG. 1. It will further be appreciated that the base 16 could have any number of slots 36.

Disposed within each of the slots 36 are a plurality of holes 38. There is a hole 38 for each signal trace 22 of a printed circuit board, as is best understood from FIG. 5. Any number of holes can be used. The holes 38 extend from the top of the base to the pockets 39 disposed in the bottom of the base, as understood with reference to FIGS. 3, 4 and 5A. As opposed to the base top, the bottom of the base is preferably flat and does not have slots.

FIG. 5B is a cross-section taken through one of the pockets 39 of FIG. 5A with the assembly installed and is representative of each pocket. As shown one of the metallic elements 44 extends down through a hole 38 into the pocket 39. In the preferred embodiment shown, the hole 38 is smaller in diameter or in cross section than the pocket 39. This is because the hole 38 needs only to be large enough to receive the prong 44, while the pocket 39 needs to be large enough to house the fusible element 48. The shape and the size of the holes 38 and pockets 39 can be varied, however, to fit any suitable metallic element 44 and fusible element 48.

In a preferred embodiment, there is a metallic element 40 disposed in each hole 38. The metallic elements 40 extend from the top of the base through a hole 38 and into the base pockets 39 as shown in FIGS. 3 and 4. The metallic elements 40 may take any of a variety of shapes. For example, as shown in FIG. 5, the metallic elements 42 may have a single prong 44 which extends through to the bottom of the hole, and a pair of prongs 46 that are electrically connected to a signal trace of the circuit board, as shown in FIGS. 5 and 6. Preferably, each of the printed circuit board assemblies 14 has a solder pad 28 disposed over the lower portion of the lateral face. The solder pads 28 are in electrical connection with the signal traces 22. The pair of prongs 46 can contact the solder pads, thereby placing the signal traces 22 in electrical connection with the metallic elements 40.

Disposed within each pocket 39 is a fusible element 48, as shown in FIG. 4. When the connector 10 is attached to another element such as another circuit board, the fusible elements 48 provide an electrical connection between the signal traces 22 of the printed circuit board assemblies and the circuits of the second element. The fusible elements 48 are preferably solder balls. Each of the fusible elements 48 are disposed within one of the base pockets 39. The metallic elements' single prongs 44 extend into the pockets so that when the fusible element is melted it attaches to the respective single prong 44 in the base pocket 39 to form an electrical connection.

Figure 7:
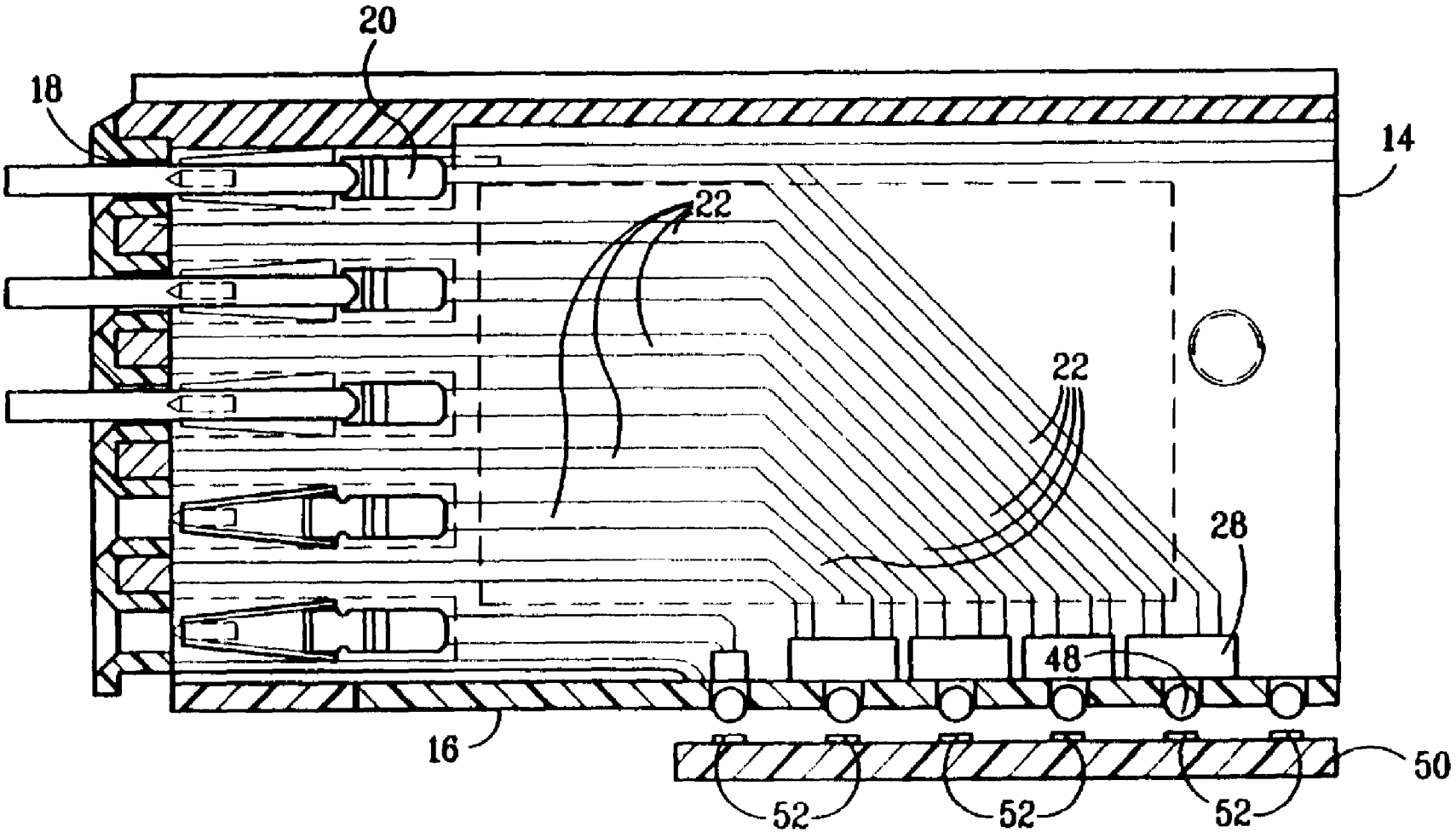
FIG. 7 is a side view of the preferred embodiment of the connector of FIG. 1 being connected to an electrical component.

Illustrated in FIG. 7 is a schematic cross sectional view depicting the mating of the connector 10 to another electrical component 50, which in the embodiment shown is a printed circuit board. FIG. 7 also depicts the electrical connections between the electrical component 50, the fusible elements 48, and the circuit board assemblies 14. As shown, each of the fusible elements 48 of the printed circuit board assembly 14 extends proximal to a corresponding receptacle 52, which is preferably a solder pad, of the mating printed circuit board assembly 50. Thus, an electrical connection is provided between the printed circuit board 10 and the mating printed circuit board assembly 50. The mating printed circuit board assembly 50 is provided here by way of example. It will be appreciated that numerous other mating assemblies or connectors can be used with the assembly 10 and the assembly 50 is used here for illustrative purposes.

As shown, the assembly 14 is inserted into a base slot 36, and fits between the prongs 46 of the metallic element 40. The solder pads 28 contact one of the prongs 46 to make an electrical connection between the assembly signal traces and the metallic element 40. The single prong 44 extends from the pair of prongs 46 and the slot 36 into the pocket 39, where it is attached to a fusible element 48. As shown, the hole 38 may be narrower than the pocket 39 and houses the single prong 44, while the pocket 39 houses the larger fusible element 48. Disposed within the slot 36, the hole 38 and the pocket 39 may be solder paste which is melted to fuse the metallic element 40, solder pads 28, and fusible elements to each other.

Connector 50 as described above mates with the base 16. FIG. 7 also shows the contact 52 of connector mated with the fusible element 48.

Figure 6B:
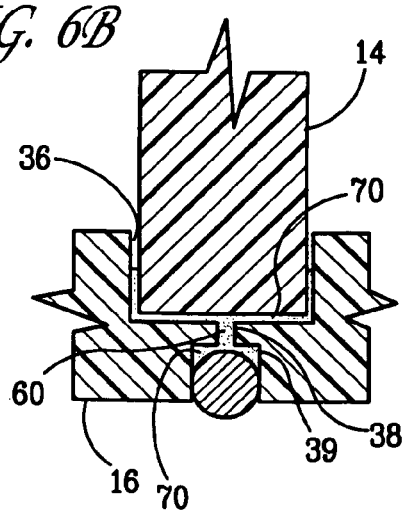
FIG. 6B is a cross-section taken through one of the base pockets of FIG. 6A with the assembly installed.
Figure 6B:
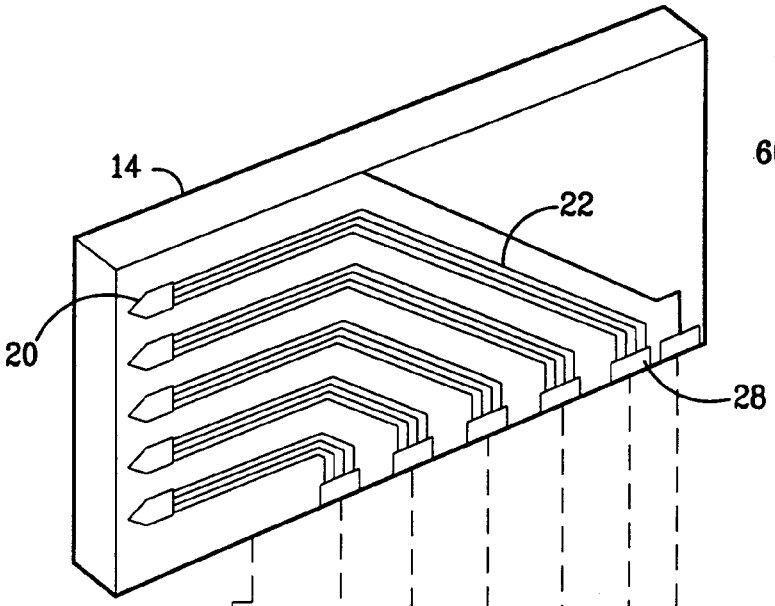
Figure 6A:
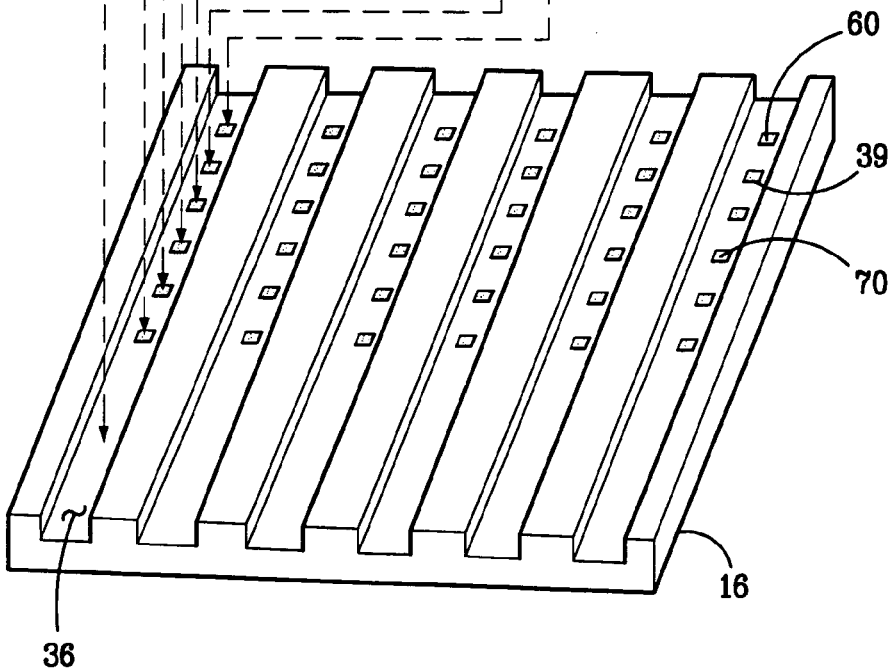
FIG. 6A is an assembly view of a printed circuit board and a base according to a second preferred embodiment of this invention.

In another preferred embodiment, which is shown in FIGS. 6A and 6B, metallic elements 44 are not used. These figures are similar to FIGS. 5A and 5B except that no metallic element 40 is used. Each printed circuit board assembly 14 is inserted into a base slot 36. Solder paste 70 or another suitable material is disposed within the slot 36 and in the base holes 38 and pockets 39. The solder paste 70 is heated so that it flows in the slot 36, the holes 38 and the pockets 39, and adheres to the solder pads or the signal traces. The solder paste 70 then provides an electrical connection from the signal traces to the fusible elements. Solder pads need not be used, but may be used in this embodiment.

The method of forming the connector 10 preferably includes assembling each of the printed circuit board assemblies 14, and then inserting each printed circuit board assembly 14 into a housing 12. This includes disposing each of the signal traces between the prongs of a metallic element 40, if a metallic element 40 is used. This is accomplished by inserting the circuit board assemblies into the base slots. Solder paste if used is heated and flows in the slots 36 and around the signal traces and metallic elements 40. Each of the fusible elements 48 is then inserted into the housing base pockets 39. The base 16 is attached to the printed circuit board assemblies, and the base 16 and assemblies 14 are attached to the housing 12. An electrical component is then aligned with the base 16 and attached to the base 16. This includes forming the electrical connection between each fusible element 48 and a corresponding element of the electrical connector 50 by heating and flowing the fusible elements 48 to form the electrical connections, as shown in FIG. 5.

An advantage of one embodiment of this invention that uses metallic components 40 to make the electrical connection between the circuit board assemblies 14 and the solder balls 48 is that the metallic components 40 provide better more reliable connections than solder balls 48 melted and adhered directly to the circuit board assemblies 14. Moreover, the metallic elements 40 provide better lateral support for the circuit board assemblies 14.

An advantage of embodiments of this invention that employ the base 16 is that the base 16 provides a mating structure between the circuit board assemblies 14 and another electrical component 50. The base houses the solder balls, provides a structure on which to mount the circuit board assemblies, and provides discrete pockets for melting the solder balls to obtain a reliable connection between the solder balls and the electrical component 50.

The broad sense of this invention includes a printed circuit board assembly 10 that has fusible elements on a wall of the printed circuit board. It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An electrical connector, comprising:

a housing comprising a base;

at least one circuit board disposed within the housing and comprising at least one signal trace having a first end disposed at a first side of the base;

at least one fusible element disposed adjacent the housing base for forming an electrical connection between the electrical connector and an electrically-conductive element on a mounting surface for the electrical connector, wherein the mounting surface is disposed at a second side of the base opposite the first side of the base; and solder paste that couples the signal trace first end to the at least one fusible element.

2. The connector of claim 1, further comprising at least one solder pad that couples the solder paste to the signal trace first end.

3. The connector of claim 1, wherein the base comprises a first side defining a slot that receives the at least one circuit board, a second side having a pocket aligned with the slot, the pocket receiving the at least one fusible element, and a hole that connects each pocket to the slot.

4. The connector of claim 3, wherein the solder paste extends from the base slot, through the base hole, and into the base pocket to place the at least one signal trace in electrical contact with the at least one fusible element.

5. The connector of claim 3, wherein the signal trace terminates in the slot and does not extend into the hole.

6. The connector of claim 3, wherein the signal trace first end is connected to a solder pad that is disposed in the slot and does not extend into the hole.

7. The connector of claim 1, wherein the at least one circuit board further comprises a terminal coupled to a second end of the signal trace.

8. The connector of claim 7, wherein the housing further comprises a face having a lead in hole in which the terminal is disposed.

9. An electrical connector, comprising:

a housing comprising a base having a first side that defines a plurality of slots, a second side having a plurality of pockets associated with one of the plurality of slots, and a plurality of holes extending through the base that connect each pocket to the one of the plurality of slots;

a face having a plurality of lead in holes a plurality of fusible elements received by the pockets;

a plurality of circuit boards received by the plurality of slots such that the circuit boards can be inserted and removed from the housing, each of the plurality of circuit boards comprising:

a plurality of signal and ground traces; and a plurality of terminals extending from each of the plurality of signal traces, each of the plurality of terminals extending into one of the plurality of lead in holes;

solder paste extending from each of the fusible elements and into the holes and the slots and being in electrical communication with one of the signal traces to form an electrical connection between the electrical connector and electrically conductive elements on a mounting surface for the electrical connector.

10. The connector of claim 9, further comprising a plurality of contact pads, disposed on either side of each of the plurality of circuit boards, that are in electrical contact with the solder paste.

11. The connector of claim 9, wherein the plurality of circuit boards further comprise ground contact terminals.

12. The connector of claim 9, wherein the plurality of fusible elements comprise solder balls.

13. The connector of claim 9, wherein each of the plurality of circuit boards further comprises a substrate on which the signal and ground traces are disposed and an insulation plate disposed over the substrate.

14. The connector of claim 13, wherein each of the plurality of circuit boards further comprises an insulation spacer disposed between the substrate and the plate.

15. An electrical connector, comprising:

a housing comprising a base;

at least one circuit board disposed within the housing and comprising at least one signal trace having a first end;

at least one fusible element disposed adjacent the housing base so that the fusible element and the circuit board are positioned on opposing sides of the housing base; and solder paste that couples the signal trace first end to the at least one fusible element.

* * * * *

UNITED STATES PATENT AND TRADEMARK OFFICE

CERTIFICATE OF CORRECTION

PATENT NO. : 7,413,450 B2
APPLICATION NO. : 11/347110
DATED : August 19, 2008
INVENTOR(S) : Steven K. Forman It is certified that error appears in the above-identified patent and that said Letters Patent is hereby corrected as shown below:

COL. 6, line 24, [claim 9], after "holes" insert a semi-colon --;--

COL. 6, line 24-25, [claim 9], begin on a separate line as a separate clause "a plurality of fusible elements received by the pockets;"

Signed and Sealed this

Seventh Day of October, 2008

JON W. DUDAS
*Director of the United States Patent and Trademark Office*